US005090881A

United States Patent [19]

Suzuki et al.

[11] Patent Number: 5,090,881

[45] Date of Patent: Feb. 25, 1992

[54] VARIABLE-DISPLACEMENT VANE-PUMP

[75] Inventors: Mikio Suzuki, Hekinan; Satoshi Suto; Ikuo Okuda, both of Okazaki; Yasunori Nakawaki; Akiharu Abe, both of Susono, all of Japan

[73] Assignee: Toyoda Koki Kabushiki Kaisha, Kariya, Japan

[21] Appl. No.: 634,504

[22] Filed: Dec. 27, 1990

[30] Foreign Application Priority Data

Dec. 27, 1989 [JP] Japan ..... 1-341916

[51] Int. Cl.[5] ..... F04C 15/04

[52] U.S. Cl. ..... 418/26; 418/30

[58] Field of Search ..... 418/26, 30; 417/220

[56] References Cited

U.S. PATENT DOCUMENTS 3,523,746 8/1970 Dadian ..... 418/26

FOREIGN PATENT DOCUMENTS 60-85283 5/1985 Japan ..... 418/30

OTHER PUBLICATIONS

Karmel, A. M., "Stability and Regulation of a Variable-Displacement Vane-Pump", *Journal of Dynamic Systems Measurement & Control*, vol. 110, Jun. 1988, pp. 203-209.

*Primary Examiner*—Richard A. Bertsch
*Assistant Examiner*—David L. Cavanaugh
*Attorney, Agent, or Firm*—Oblon, Spivak, McClelland, Maier & Neustadt

[57] ABSTRACT

A variable-displacement vane-pump has a rotor which is rotatably supported by a pump housing in coaxial relationship therewith, and a cam ring interposed between the rotor and the pump housing in eccentric relationship with the pump housing. The rotor has radially outwardly slidable vanes on its outer peripheral surface in contact with an inner surface of the cam ring. Two side plates are disposed on both sides of the vanes, thereby defining pump chambers between every adjacent vanes. An arc-shaped intake port and an arc-shaped exhaust port are formed in one of two side plates, and respectively open into the pump chambers along one side face of the cam ring. In the other side face of the cam ring, a groove is formed except for the region corresponding to the exhaust port, and a partially cut off annular friction ring is disposed within the groove while urged by a seal ring into close contact with the other side plate. A pressure compensating recess having a configuration which conforms to that of the exhaust port and communicating with the pump chambers is formed in the other side face of the cam ring except for the region wherein the groove for the friction ring is formed.

5 Claims, 3 Drawing Sheets

VARIABLE-DISPLACEMENT VANE-PUMP

BACKGROUND OF THE INVENTION

1. Field of the Invention

The present invention relates to a variable displacement vane pump and, more particularly, to a structure of a pump which effectively prevents stick slip of a cam ring during its swinging movement for varying the pump displacement.

2. Description of the Prior art

Vane-pumps are known as small-sized and light-weighted pumps having a high efficiency, and have been used in various fields.

One example of variable-displacement vane-pumps out of such vane-pumps will be explained with reference to FIG. 3.

FIG. 3 is a cross sectional view of a pump portion of the variable-displacement vane pump. A drive shaft 8 is rotatably supported by a pump housing 7, and extends into a circular inner cavity of the pump housing 7 in coaxial alignment with the center axis of the inner cavity. A columnar rotor 1 is securely fixed to and rotates integrally with the drive shaft 8 in the direction shown by the arrow in FIG. 3. An annular cam ring 3 is interposed between the rotor 1 and the pump housing 7. The uppermost portion of the cam ring 3 contacts the inner surface of the pump housing 7 through a pivot member 32 while the lowermost portion of the cam ring 3 also contacts the inner wall of the pump housing 7 through a sealing member 33. Thus, the cam ring 3 swings on the pivot member 32.

The cam ring 3 is provided with a spring seat 34 at its lower portion. A coil spring 35 is disposed between the spring seat 34 and the bottom surface of a concave formed in the pump housing 7. The cam ring 3 is urged by a spring force of the coil spring 35 into its maximum eccentric position.

A plurality of vanes 2 are provided in the rotor 1 at regular intervals in a circumferential direction thereof. These vanes 2 are radially slidable inward and outward in contact with the inner surface of the cam ring 3. Upon receiving the pump discharge pressure, each vane 2 outwardly slides toward the inner surface of the cam ring 3 until a top end thereof contacts the inner surface of the cam ring 3, thereby defining closed pump chambers P together with a pair of side plates 4A, 4B, each closely facing each of both side faces of each vane 2. With the rotation of the rotor 1, each pump chamber P rotates while changing its volume.

An arc-shaped line port 41 is formed in the side plate 4B in facing relationship with the pump chamber P of which the volume gradually increases while an arc-shaped exhaust port 42 is formed in the side plate 4B in facing relationship with another pump chamber P of which the volume gradually decreases. Thus, working fluid is sucked from the intake port 41 and pressurized fluid is discharged from the exhaust port 42.

The pressurized fluid is led into a space **5*a* defined by a half portion of the outer periphery of the cam ring 3 ranging from the pivot member 32 to the sealing member 33, and the inner surface of the pump housing 7 by way of a regulator 92 (FIG. 5) while a space 5*b* defined by the remaining half portion of the outer periphery of the cam ring 3 and the inner surface of the pump housing 7 is communicated with a reservoir tank 94**.

With the increase in the flow rate of the discharge fluid from the pump, and accordingly, with the increase in the discharge pressure, the cam ring 3 starts to swing leftward in FIG. 3 on the pivot member 32 against the spring force of the coil spring 35, and the center of the cam ring 3 approaches the rotational center of the rotor 1.

As the eccentricity of the cam ring 3 decreases, the volume change of the pump chambers P decreases with the result that the discharge rate decreases.

FIG. 5 shows a diagram showing the flow route of working fluid, wherein 91 designates a vane pump, and 93 designates a load. A part of pressurized fluid is led to the space **5*a* of the vane pump 91 through the regulator 92, which controls the pressure of the fluid led to the space 5*a* in response to a control signal(not shown). As a result, the pressure in the space 5*a* of the vane pump 91 changes in proportion to the control signal so that the displacement of the vane pump 91** is controlled in accordance with the control signal.

In the conventional vane pump having the above described construction, when a preceding vane 2 of each pump chamber P reaches the intake port 41 with the rotation of the rotor 1, and when the preceding vane 2 reaches the exhaust port 42 with the rotation of the rotor 1, the inner pressure of each pump chamber P suddenly changes. This results in eccentric loads periodically acting upon the cam ring 3 in its swinging directions, generating undesirable hunting of the cam ring 3. This hunting of the cam ring 3 causes the unstable control of the discharge rate of the pump, and causes the generation of noise.

Accordingly, conventionally, as shown in FIG. 3, the vibrations of the cam ring 3 have been prevented by providing a friction ring 6 having a rectangular cross section along one side face of the cam ring 3 over the entire length thereof. More specifically, a circular groove 36 is formed in the entire side face **3*a* of the cam ring 3, as shown in FIG. 4. A circular seal ring 61 is disposed within the groove 36. The friction ring 6 is brought into close contact with the side plate 4A by an elastic force of the seal ring 61. thereby generating a friction force between the friction ring 6 and the side plate 4A, and preventing the vibrations of the cam ring 3**.

One example of the friction ring employed in the variable-displacement pump is disclosed in Japanese unexamined Utility Model publication No. Sho 59-160875.

However in the above-described conventional variable-displacement vane-pump, the discharge pressure from the exhaust port 42 acts upon the other side face **3*b* of the cam ring 3, which faces tthe exhaust port 42. This discharge pressure causes an excessively large pushing force to act upon the friction ring 6, thereby excessively increasing the friction force between the friction ring 6 and the cam ring 3, and accordingly, causing the generation of undesirable stick slip of the cam ring 3** during its swinging movement.

SUMMARY OF THE INVENTION

It is an object of the present invention to provide a variable-displacement vane-pump which effectively prevents vibrations of a cam ring without generating stick slip during the swinging movement of the cam ring.

The variable-displacement vane pump in accordance with the present invention has a pump housing, a drive shaft rotatably supported by the pump housing in coaxial relationship therewith, a rotor supported by the drive shaft to be rotated integrally with the drive shaft within tee pump housing. The rotor is provided with a plurality of vanes at regular intervals in the circumferential direction on the outer peripheral surface thereof. These vanes are radially slidable outward and inward with the rotation of the rotor. A cam ring is interposed between the rotor and the pump housing in eccentric relationship with the pump housing, thereby defining two spaces between respective half portions of an outer periphery of the cam ring and an inner surface of the pump housing. One of the two spaces between the cam ring and the pump housing is communicated with a pressure source. Two side plates are respectively provided on both sides of the vanes. A top end of each vane contacts the inner surface of the cam ring, thereby defining pump chambers between the rotor and the cam ring. An intake port for successively sucking working fluid into the pump chambers, and an exhaust port for successively discharging pressurized working fluid from the pump chambers, are provided in one side plate, and the inner end of the exhaust port faces one side face of the cam ring. A friction ring is provided between the cam ring and one of the side plates. The friction ring is urged by an elastic member into contact with the facing side plate. A pressure compensating recess is formed at the other side face of the cam ring, which is opposite to the one side face upon which the exhaust port opens. The pressure compensating recess has a configuration which conforms to that of the exhaust port, and is communicated with the pump chambers.

In operation, working fluid is successively sucked from the intake port into pump chambers, and the sucked fluid is successively pressurized and discharged from the pump chambers into the exhaust port. The cam ring is swung from its eccentric position toward its coaxial position with respect to the pump housing in accordance with the pressure of the pressure source, and accordingly adjusting the discharge rate.

By providing the pressure compensating recess, the discharge pressure of the exhaust port also acts upon the side surface of the cam ring, which is opposite to the side surface facing the exhaust port. This discharge pressure is substantially equal to that acting upon the side surface of the cam ring, which faces the exhaust port, because the pressure compensating recess has a configuration conforming to that of the exhaust port. This results in the cam ring being not excessively pressed in only one direction by the discharge pressure of the exhaust port, and the pushing force acting on the friction ring being reduced to a proper value. Therefore, stick slip is prevented from generating when the cam ring swings to its opposite side, and hunting of the cam ring can be restrained.

DETAILED DESCRIPTION OF THE EMBODIMENT

Figure 1:
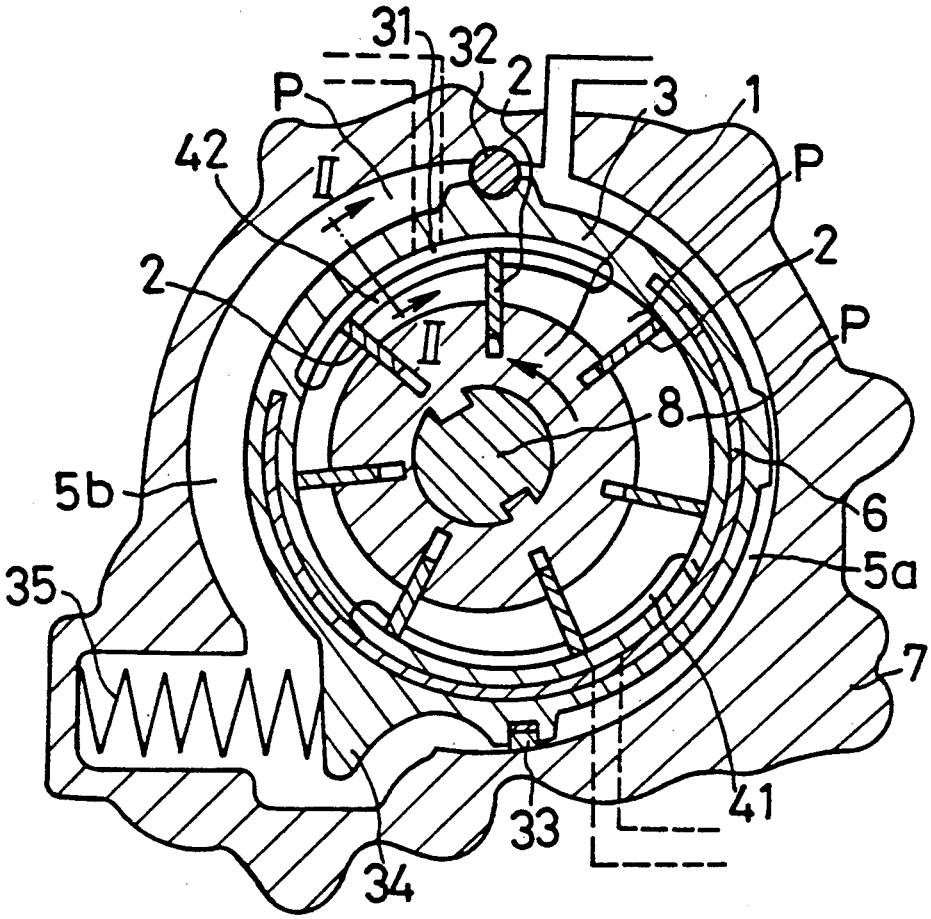
FIG. 1 is a cross-sectional view of a pump portion of a first embodiment of a variable-displacement vane-pump in accordance with the present invention.
Figure 2:
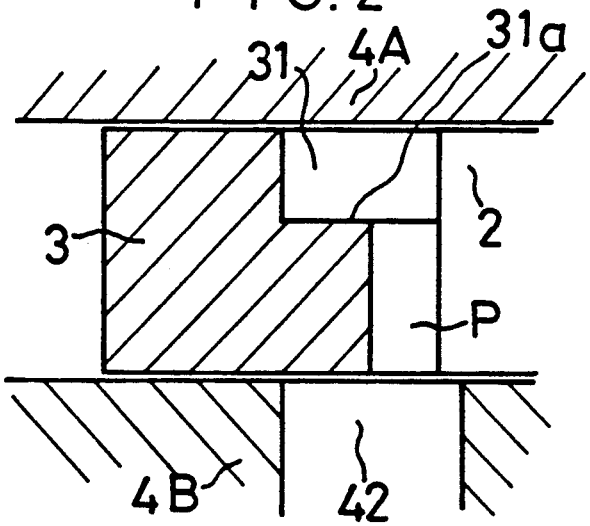
FIG. 2 is an enlarged longitudinal sectional view taken along the line II—II of FIG. 1.
Figure 3:
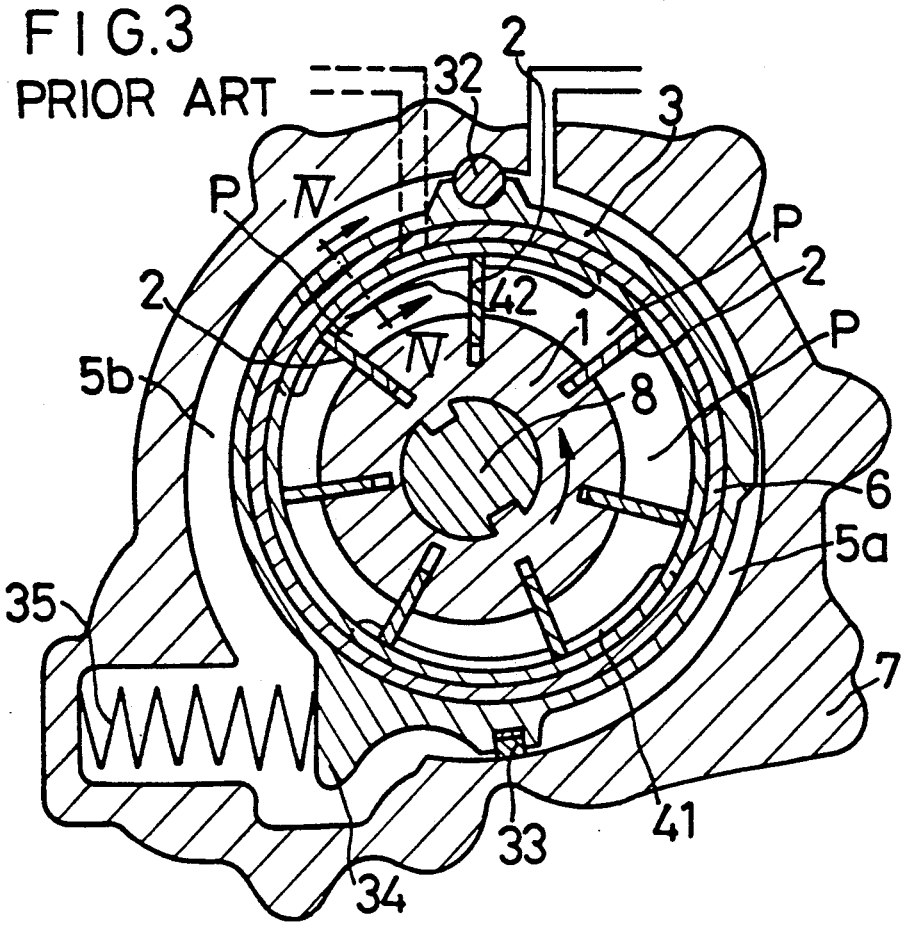
FIG.3 PRIOR ART
FIG. 3 is a cross sectional view of a pump portion of a conventional variable-displacement vane-pump.

Referring to FIG. 1, there is shown a pump portion of a first embodiment of a variable-displacement vane-pump in accordance with the present invention.

A rotor 1 is fixed to a drive shaft 8 which is rotatably supported by a pump housing 7 and extends into its inner cavity in coaxial alignment with the center axis of the inner cavity. A cam ring 3 is interposed between the rotor 1 and the pump housing 7, and is pivotably supported at an uppermost inner surface of the pump housing by means of a pivot member 32. Vanes 2 are provided in the rotor 1 at regular intervals in the circumferential direction thereof, and are slidable radially outward and radially inward so that& a top end of each vane 2 is brought into contact with the inner surface of the cam ring 3. Two side plates 4A, 4B are respectively disposed on both side faces of the vanes 2, thereby defining pump chambers P between every two adjacent vanes 2. An arc-shaped intake port 41 and an arc-shaped exhaust port 42 are provided in one side plate 4B, and a radially inner half portion of each of these ports 41, 42 opens into the pump chambers P.

Figure 4:
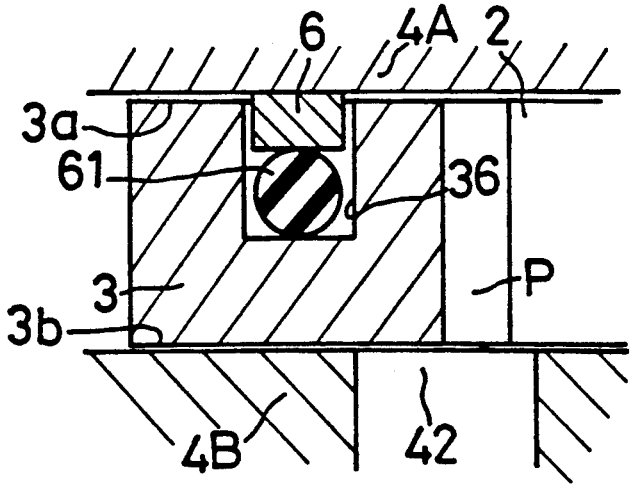
FIG.4 PRIOR ART
FIG. 4 is an enlarged longitudinal sectional view taken along the line IV—IV of FIG. 3.
Figure 5:
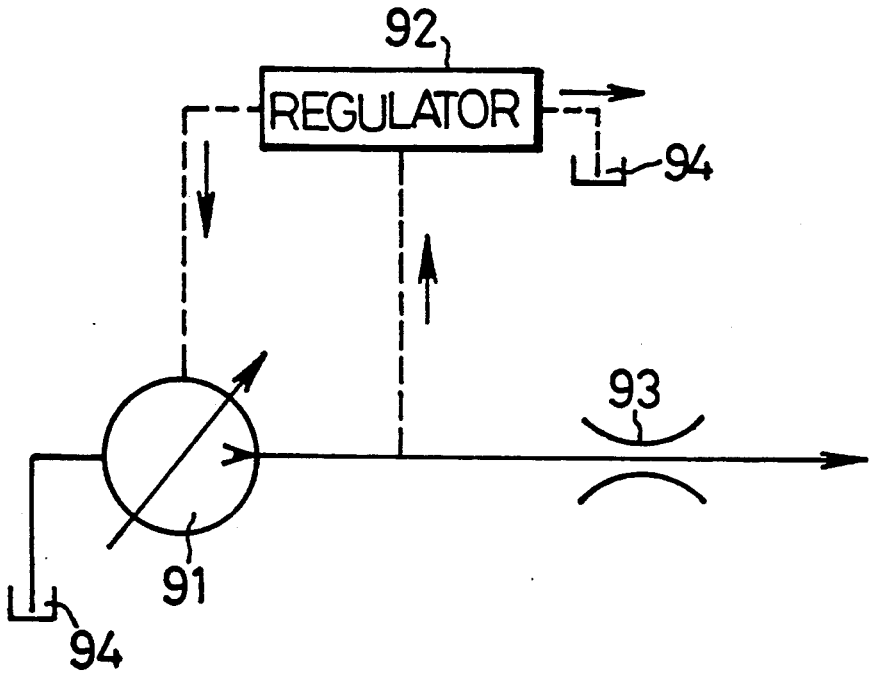
FIG. 5 is a diagram showing the flow route of working fluid.

One side face of the cam ring 3 faces a radially outer half portion of the exhaust port 42. A partially cut off annular friction ring 6 is provided between the side face of the cam ring 3, which does not face the exhaust port 42, and the side plate 4A except for the region corresponding to the exhaust port 42. The friction ring 6 is urged by a partially cut off seal ring 61 toward the side plate 4A, as shown in FIG. 4.

And a pressure compensating recess 31 having an acting surface 31*a* which is parallel to the inner surface of the side plate 4A, and equal to that of the radially outer half portion of the exhaust port 42 is formed in the side face of the cam ring 3, which does not face the exhaust port 42, except for the region wherein the friction ring 6 is provided, as shown in FIG. 1.

Reference numeral 33 designates a sealing member for bringing the cam ring 3 into sealing engagement with the inner surface of the pump housing 7. Reference numeral 34 designates a spring seat for a coil spring 35 which urges the cam ring 3 to be positioned at its eccentric position with respect to the pump housing 7. Reference numerals 5*a*, 5*b* respectively designate spaces defined by halves of the outer periphery of the cam ring 3 and the inner surface of the pump housing 7.

In operation, when the rotor 1 rotates, working fluid is sucked from the intake port 41 into each pump chamber P defined by adjacent vanes 2, and the pressurized fluid is discharged from the exhaust port 42. At this time, discharge pressure of the line port 42 acts upon both side faces of the cam ring 3. Namely, the discharge pressure acts upon one side face of the cam ring 3, which directly faces the exhaust port 42, and the discharge pressure also acts upon the other side face of the cam ring 3 through the pressure compensating recess 31. This prevents the cam ring 3 from being excessively pressed against the side plate 4A through the friction ring 6.

Therefore, the friction ring 6 is pressed against the side plate 4A by a proper elastic force of the seal ring 61, so the cam ring 3 is restrained from hunting. Furthermore, when the cam ring swings with the change of the displacement of the pump, the generation of stick slip of the cam ring can be prevented because the friction ring 6 is provided over the entire side face of the cam ring 6 except for the region corresponding to the exhaust port 42.

The present invention is not limited to the above-described embodiment. For example, the exhaust port is provided in only one of two side plates in the above-described embodiment. Instead, the exhaust port may be provided in both side plates. And these exhaust ports may have sizes different from each other.

As described above, in accordance with the variable-displacement vane pump of the present invention, both the friction ring and the pressure compensating recess can be provided in the cam ring without increase in the outer diameter thereof. This construction restrains hunting of the cam ring, and realizes the smooth swinging movement& of the cam ring without stick slip thereof.

What is claimed is:

1. A variable-displacement vane-pump, comprising:

a pump housing:

a drive shaft rotatably supported by said pump housing in coaxial relationship therewith;

a rotor which is supported by said drive shaft to be rotated integrally with said drive shaft within said pump housing, said rotor being provided with a plurality of vanes at regular intervals in the circumferential direction on the outer peripheral surface thereof said plurality of vanes being radially slidable outward and inward with the rotation of said rotor;

a cam ring interposed between said rotor and said pump housing in eccentric relationship with said pump housing, thereby defining two spaces between respective half portions of an outer periphery of said cam ring and an inner surface of said pump housing, one of said two spaces between said cam ring and said pump housing being communicated with a pressure source so that said cam ring is swung from its eccentric position to its coaxial position with respect to said pump housing to adjust discharge rate in accordance with the pressure of said pressure source;

two side plates respectively provided on both sides of said vanes, a top end of said vane contacting the inner surface of said cam ring, thereby defining pump chambers between said rotor and said cam ring:

an intake port for successively sucking working fluid into said pump chambers, and an exhaustt port for successively discharging pressurized working fluid from said pump chambers, said intake port and said exhaust port being provided in one side plate, and opening upon one side face of said cam ring;

a friction ring provided between said cam ring and one of said two side plates, said friction ring being urged by an elastic member into contact with said one of said two side plates; and a pressure compensating recess formed at the other side face to said cam ring, which is opposite to said one side face upon which said exhaust port opens, said pressure compensating recess having a configuration which conforms to that of said exhaust port, and being communicated with said pump chambers.

2. The variable-displacement vane-pump according to claim 1, wherein said friction ring is partially cut off at a region corresponding to said exhaust port.

3. The variable displacement vane-pump according to claim 1 wherein said cam ring is pivotally supported by said pump housing at one outer peripheral portion of said cam ring, said cam ring slidably contacts the inner surface of said pump housing at another outer peripheral portion through a sealing member, and a spring member is further provided in contact with one of said half portions of said outer periphery of said cam ring, which does not face said space in which said pressurized working fluid is introduced, whereby said cam ring is swung from its eccentric portion by an amount corresponding to the pressure of the pressurized working fluid.

4. The variable displacement vane-pump according to claim 2, wherein said exhaust port is composed of an arc-shaped slot formed along an inner surface of said cam ring, and a radially outer portion of said exhaust port is covered with an facing side face of said cam ring.

5. The variable displacement vane-pump according to claim 2, wherein said cam ring is provided with a groove which extends in a circumferential direction of the side face which is opposite to the side face facing said exhaust port, except for the region corresponding to said exhaust port, said partially cut off friction ring has a rectangular cross-sec&ion, and said elastic member is composed of a seal ring, and said partially cut off friction ring and said seal ring are disposed within said groove so that said seal ring urges said partially cut off friction ring into close contact with the facing side plate.

* * * * *